US006038973A

United States Patent [19]

Marmin

[11] Patent Number: 6,038,973

[45] Date of Patent: Mar. 21, 2000

[54] WEB INFEEDING OR THREADING DEVICE FOR ROTARY PRINTING PRESSES

[75] Inventor: Jean Claude Marmin, Estrees-Saint-Denis, France

[73] Assignee: Heidelberger Druckmaschinen AG, Heidelberg, Germany

[21] Appl. No.: 09/106,413

[22] Filed: Jun. 29, 1998

[30] Foreign Application Priority Data

Jun. 27, 1997 [FR] France ..... 97 08112

[51] Int. Cl.[7] ..... B41F 13/56

[52] U.S. Cl. ..... 101/225; 226/92

[58] Field of Search ..... 101/219, 220, 101/225, 228; 226/91, 92

[56] References Cited

U.S. PATENT DOCUMENTS

| | | | |
|---|---|---|---|
| 1,900,535 | 3/1933 | Wood | 101/225 |
| 2,097,251 | 10/1937 | Lougee | 101/225 |
| 2,862,705 | 12/1958 | Faeber | 101/228 |
| 2,944,345 | 7/1960 | Faeber | 101/228 |
| 3,529,755 | 9/1970 | Spangenberg et al. | 225/4 |
| 3,587,461 | 6/1971 | Polglase | 101/228 |
| 3,995,553 | 12/1976 | Winterholler et al. | 101/228 |
| 4,111,122 | 9/1978 | Kutzner et al. | 101/228 |
| 4,598,850 | 7/1986 | Winterholler et al. | 101/228 |
| 4,706,862 | 11/1987 | Theilacuer | 226/92 |
| 4,987,830 | 1/1991 | Fukada et al. | 101/228 |

FOREIGN PATENT DOCUMENTS

0418903A2 3/1991 European Pat. Off. .

*Primary Examiner*—Eugene Eickholt
*Attorney, Agent, or Firm*—Herbert L. Lerner; Laurence A. Greenberg; Werner H. Stemer

[57] ABSTRACT

A web threading device for rotary printing presses, having a flexible, endless threading element for threading a web of material along a web path through components of a rotary printing press, includes a transporter assigned to the threading element, the transporter passing by the components of the rotary printing press, the threading element being actuatable for taking up a leading end of the material web.

17 Claims, 5 Drawing Sheets

WEB INFEEDING OR THREADING DEVICE FOR ROTARY PRINTING PRESSES

BACKGROUND OF THE INVENTION

FIELD OF THE INVENTION

The invention relates to a web threading or infeeding device for rotary printing presses, especially those presses having printing units that are arranged in tandem or above one another, the web infeeding device having a flexible, endless infeed or threading element, which threads a material web along a web path through the components of a rotary printing press.

In the prior art, the German Published Patent Document DE 24 02 768 C2, discloses a device for threading or infeeding material webs in rotary printing presses. This device provides an endless, flexible threading or infeeding element having a length which is somewhat greater than the distance between adjacent drive units. A number Of the drive units are provided in order to move the threading or infeeding element in guides and deflectors along a threading or infeeding path. Provided along the threading or infeeding path are sensors for switching on a respectively required drive element and for simultaneously switching off the drive element that is no longer required, the sensors being actuated by the threading or infeeding element.

The published German Patent Document DE 25 32 168 C3 relates to a method and a device for threading or infeeding a paper web in rotary printing presses. A flexible conveyor that runs out of a storage and is guided by a number of guides fixed to the housing is provided with a hook-in device for a starting end of the material web to be guided. The material web is hooked onto a conveyor which can be withdrawn from a first storage and which can be coupled to a second conveyor that is guided on a predefined path and which, in turn, can be coupled to a third, flexible conveyor that can be drawn into a driven second storage. The conveyors can be drawn into the storage. After the material web has been detached from the conveyors, the latter can be drawn back again by the first storage.

The published European Patent Document EP 0 533 042 A1 discloses a device for threading or infeeding webs in web-fed rotary printing presses. An endless belt system, which is guided on the threading path and to which the web to be threaded is fastened, is proposed. A threading belt in the form of a hook belt is guided on the threading path. The starting end of the belt carries a loop belt. In addition to cost-effective construction, this device is also intended to enable the threading of partial webs into the rotating rolls via turning bars.

The published European Patent Document EP 0 418 903 B1 has disclosed a paper-web threading or infeeding device for web-fed rotary printing presses. Provided along a paper-web threading path is an paper-web element threading or infeeding guide, which runs from a paper-web feeding section to a position directly upstream of a folding section. The paper-web threading element, which extends over the entire length of the paper-web insertion path, is arranged at that position on the path that is located farthest upstream. During the paper-web threading operation, the threading element is driven along the paper-web element threading guide. Provided on the paper-web threading element is a paper-web holding element for firmly holding the paper web to be threaded along the path. In addition, at least one paper-web element threading guide is provided. According to this effective construction, a paper-web threading element take-up or receiving section that is arranged downstream of the paper-web threading path is provided and takes up or receives the leading end of a paper-web threading element which has a trailing end that is connected to a paper web. The threading element can be moved by this take-up or receiving section, which may be connected to any desired guides selected from a multiplicity of paper-web threading guides.

SUMMARY OF THE INVENTION

It is accordingly an object of the invention to provide an improved web threading or infeeding device for rotary printing presses wherein a material web to be threaded or infed is loaded uniformly loaded or stressed during the threading operation.

With the foregoing and other objects in view, there is provided, in accordance with one aspect of the invention, a web threading device for rotary printing presses, having at least one flexible, endless threading element for threading a web of material along a web path through components of a rotary printing press, comprising at least one transporter assigned to the at least one threading element, the transporter passing by the components of the rotary printing press, the threading element being actuatable for taking up a leading end of the material web.

In accordance with another feature of the invention, the threading element is connectable to the transporter.

In accordance with a further feature of the invention, the transporter has a connecting point for the threading element.

In accordance with an added feature of the invention, the transporter runs along a side of the rotary press.

In accordance with an additional feature of the invention, the web threading device includes a drive station for driving the threading element.

In accordance with yet another feature of the invention, the web threading device includes drive stations for driving the transporter.

In accordance with yet a further feature of the invention, the transporter is movable in a threading direction of the web and in a direction opposite thereto.

In accordance with yet an added feature of the invention, the web threading device includes respective drive stations for driving the threading element and for driving the transporter, the drive stations having electromotive drives.

In accordance with yet an additional feature of the invention, the web threading device includes respective drive stations for driving the threading element and the transporter, the drive stations having hydraulically actuated drives.

In accordance with still another feature of the invention, the transporter and the threading element, respectively, are formed of a flexible, temperature-resistant belt.

In accordance with still a further feature of the invention, the transporter has a chain-like construction.

In accordance with still an added feature of the invention, the drive stations of the threading element are mounted on a traverse.

In accordance with still an additional feature of the invention, the drive stations of the threading element are displaceable on the traverse, perpendicularly to a web threading direction.

In accordance with another feature of the invention, the transporter runs on the operating side of the rotary press and enables access to the components of the rotary press via activatable turning members.

In accordance with a further feature of the invention, the turning members are hydraulically actuated cylinders.

In accordance with an added feature of the invention, the threading element is actuatable for taking up a web on a web threading element at a point on a leading edge of the web.

In accordance with an additional feature of the invention, the web threading device includes at least another transporter and at least another threading element, the threading elements being respectively connectable to the transporters.

In accordance with another aspect of the invention, there is provided a web-fed rotary printing press having a web threading device, including a flexible, endless threading element for threading a web of material along a web path through components of a web-fed rotary printing press, comprising a transporter assigned to the threading element, the transporter passing by the components of the rotary printing press, the threading element being actuatable for taking up a leading end of the material web.

In accordance with a concomitant feature of the invention, in the web-fed rotary printing press, the components thereof include printing units arranged in tandem or above one another.

The construction according to the invention offers the advantage that, during the threading of the material web, the forces exerted on the latter are introduced uniformly into the material web; the threading elements engage with the material web at the web point or tip and not at a side of the material web, so that a tensile force acts on the center of the material web. The material web, or longitudinally slit partial webs, can thereby be threaded in such a manner that no misrunning of the web or of the webs occurs during the threading, and the material web is thus already inserted or infed approximately into the required position thereof in the press. Because the threading elements draw or pull the material web up to the turning-bar superstructure, it is also possible for a simple threading over the turning bars to be performed. The assignment of transporters to the threading elements enables the threading elements to be retransported simply to the location at which they are required for newly threading a web.

In a further realization of the concept upon which the invention is based, the threading elements can be connected to the transporters. In order to pick or take up the threading elements, connecting points are provided on the transporters, so that the threading elements can be moved back again to the reel changer, while the rotary press is in operation. The transporter or transporters may run along one or both sides, respectively, of the web-fed rotary printing press; if one threading element is used for threading a web, one transporter is sufficient; if two partial webs are threaded into different web paths, it is possible to provide a plurality of threading elements and correspondingly many transport elements.

The threading elements have a respective drive station, and the transporters are provided with respective drive stations, it being possible for the transporters to be moved in the web threading direction and in a direction opposite thereto. The drive stations may be provided either with electric-motor drives or with hydraulically actuated drives.

The transporters, like the threading elements, may comprise flexible belts which are capable of coping with small bending radii. Furthermore, the transporters may also be constructed is in the form of a chain. The drives for the threading elements may advantageously be mounted on a traverse or crossmember. In order to adjust the position of the drives for the threading elements, the latter may be displaced on the traverse, perpendicularly or at right angles to the threading direction, so that precise positioning of the threading elements in relation to the leading edge of the material web can be set.

If a transporter for retransporting a corresponding threading element is provided on the operating side of the press, it is possible for the transporter to be lowered into the foundation, out of the accesses to the press components, by suitably activatable turning members, such as hydraulically actuated cylinders, so that unimpeded access to the printing units, to the dryer and so forth is possible.

The threading elements are preferably fastened by somewhat triangular web elements around which the web points or tips can be wound, so that the tensile force required for the threading can be introduced uniformly into the web or the partial web.

Other features which are considered as characteristic for the invention are set forth in the appended claims.

Although the invention is illustrated and described herein as embodied in a web threading or infeeding device for rotary printing presses, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE DRAWINGS

FIG. 4 is a reduced perspective view like that of FIG. 3 of web paths for two partial webs to be infed or threaded in;

DESCRIPTION OF THE PREFERRED EMBODIMENTS

Figure 1:
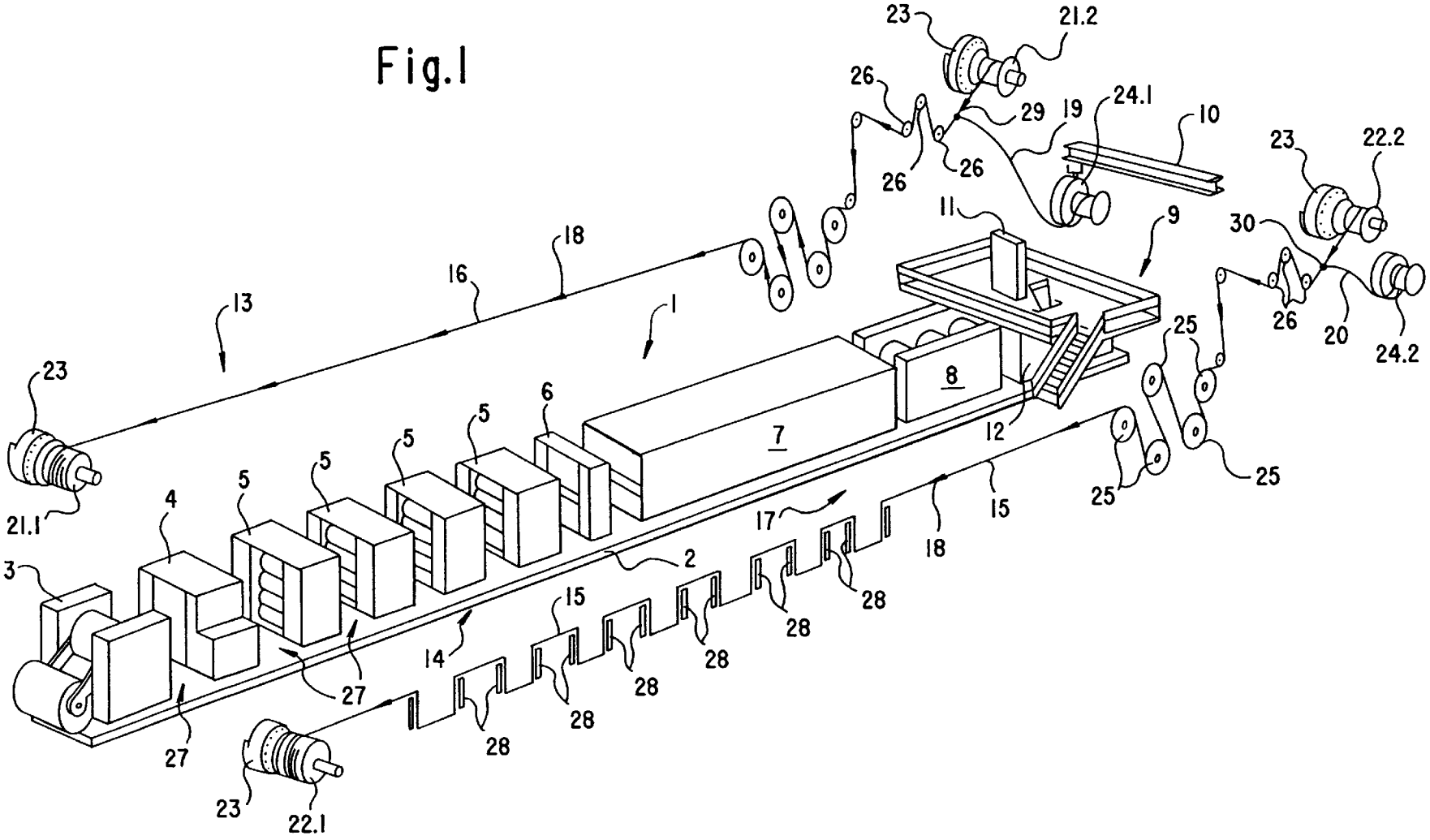
FIG. 1 is a diagrammatic perspective overall view of a web threading or infeeding device according to the invention extending over the length of the rotary press.

Referring now to the drawings and, particularly, to FIG. 1 thereof, there is presented therein an overall view of a web threading or infeeding device according to the invention extending over the length of a rotary printing press 1.

The web-fed rotary printing press 1 is erected on a foundation 2 and includes, for example, a reel changer 3, an infeed unit 4, a plurality of printing units 5 and a safety device 6 disposed upstream of a continuous dryer 7, as viewed in a direction of travel of an infed web. The dryer 7 is followed by a cooling-roller group 8 and a folding-apparatus cylinder part 9, including a turning-bar superstructure 11.

Figure 4:
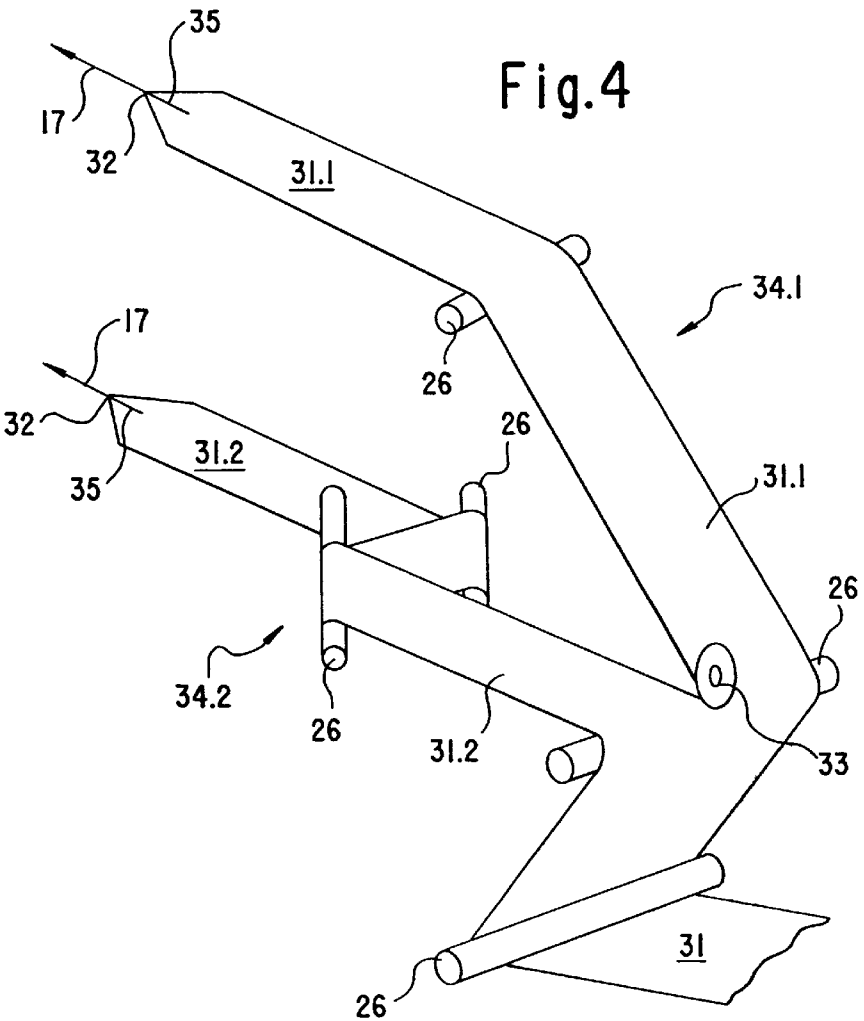

In the illustrated embodiment of FIG. 1, there is provided a respective transporter or conveyor 15, 16 on the drive side 13 and the operating side 14 of the rotary press 1, as well as a respective threading or infeeding element 19, 20 with which it is possible, for example, for two partial webs 31.1, 31.2, respectively, according to FIG. 4, to be drawn or pulled in on different web paths. Instead of the two threading elements 19 and 20 and the two transporters or conveyors 15, 16, it would also be possible to provide only one threading element 19 in conjunction with one transporter 15, for example, in order to enable the threading or infeeding of only one web 31 (note FIGS. 3, 4, 7 and 8).

On the drive side 13, the transporter 16, which may be constructed as a flexible, temperature-resistant belt, formed as a steel cable rope or as a chain, for example, is driven by two drive stations 21.1 and 21.2 formed as winches or capstans in this embodiment. With the aid of the drive stations 21.1, 21.2, it is possible to move the transporter 16 in the web threading direction 17 or else, counter thereto, in the direction 18. In the condition or phase shown in FIG. 1, a drive-side threading element 19 is connected to the transporter 16 at a connecting point 29, so that the threading element 19 can be transported back to the reel changer 3. The drive stations 21.1 and 21.2 for the transporter 16 may be equipped with drives 23, such as electric motors or pneumatic or hydraulic drives, for example. In addition, in the configuration shown, the threading element 19 is illustrated on the drive side 13. The threading element 19, formed of a nylon belt or of some other suitable flexible plastic material, threads the web or the partial webs into the components of the rotary press. In this regard, the threading element 19 is specifically equipped with an appropriate drive 24.1 or, in the event that partial webs are inserted and a plurality of threading elements are provided, is equipped with two drives 24.1 and 24.2. The drives 24.1 and 24.2 are displaceably mounted on a crossmember or traverse 10, which can be mounted, for example, in the superstructure 11 above the folding apparatus cylinder part 9.

In the configuration illustrated in FIG. 1, it is possible for the two threading elements 19 and 20 to be hooked into the respective transporters or conveyors 15, 16 at the respective connecting points 29 and 30 which have already been mentioned herein. Thereafter, the drive stations 21.1 and 22.1 are actuated and the transporters 15 and 16, respectively, are rewound by the winches or capstans 21.1 and 22.1, so that the threading elements 19 and 20 are guided back on their path as far as the reel changer 3. At that point, the threading elements 19 and 20 or the threading element 19, as the case may be, are fastened to the leading ends of the material web. The drives 24.1 and 24.2 are then switched on, and the web is threaded through the components of the rotary press. The threading of the web is performed by the drives 24.1 and 24.2, aided by the components 4, 5, 6 and 8, which facilitate the threading by running at crawling speed. Once the material web has been threaded through the components, such as the printing units 5 and the dryer 7, the material web is led over the cooling rollers 25 of the cooling-roller stand 8 and, therefrom, over the turning bars 26 of the superstructure 11 to the folding apparatus cylinder part 9.

The threading elements 19 and 20, which thread the web or partial webs into the rotary press, have been previously guided by the transport elements 15 and 16 over the path into which the web or partial webs to be newly threaded are intended to be threaded later. The drives 24.1 and 24.2 then draw the respective threading elements 19 and 20 through the web path previously defined by the reverse transport of the threading elements 19 and 20 through the printing units 5, the dryer 7, the cooling-roller section 8 and the turning-bar superstructure 11. In order not to impair access to the operating side 14 of the rotary press 1, if a transporter 11 is provided thereat, it is possible to lower the transporter 15 temporarily into the foundation in the region of the accesses 27 by turning members 28 shown diagrammatically in FIG. 1, so that access to the printing units, and so forth remains unimpaired by the course of the transporter 15 on the operating side 14. It should also be mentioned that the transporters 15 and 16 are always kept under pretensioning by the respective drive stations 21.1 and 21.2, in order to enable a shock-free and jolt-free web threading.

Figure 2:
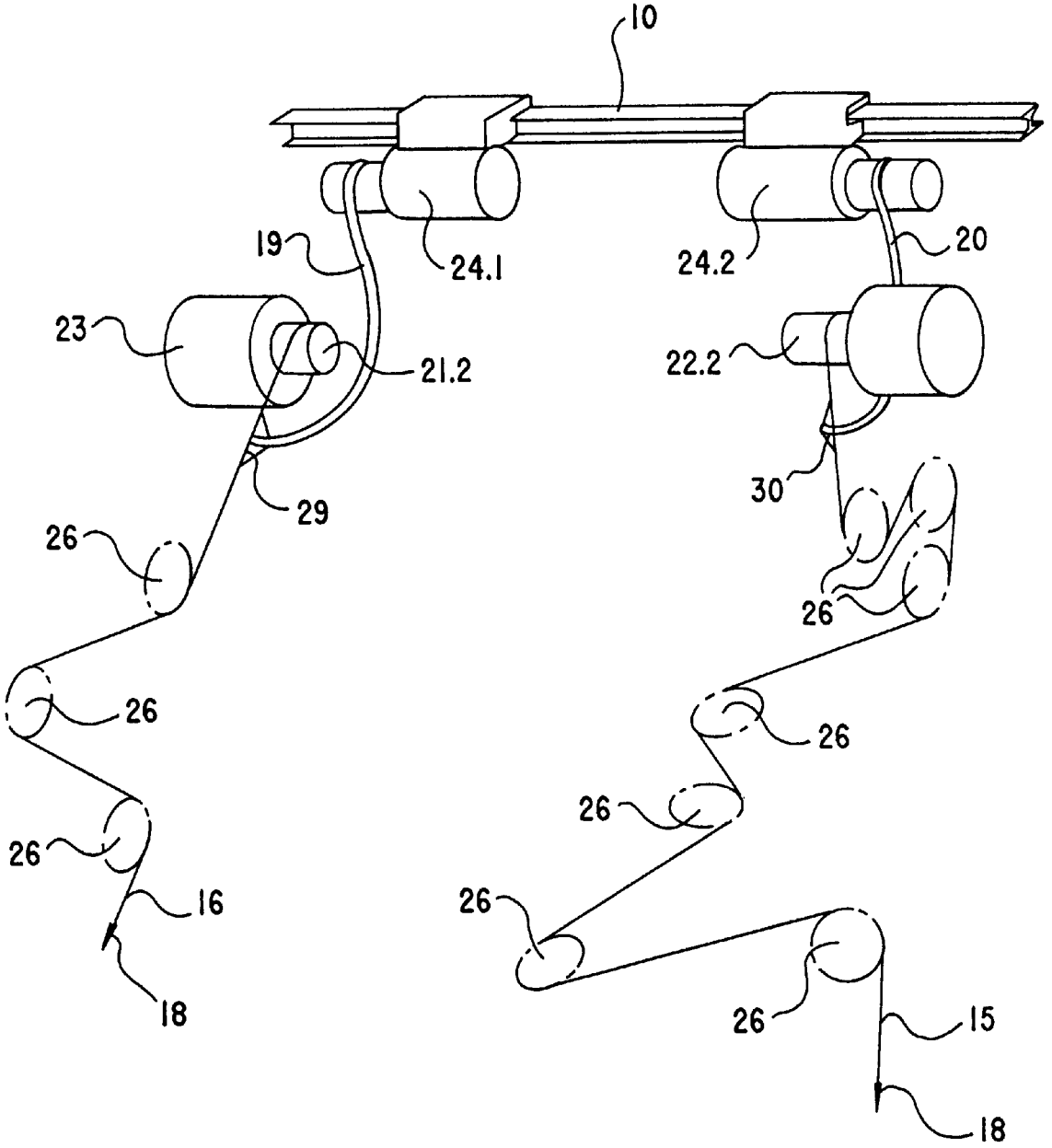
FIG. 2 is an enlarged fragmentary view of FIG. 1 showing the mounting support of the drive stations for the threading elements.

FIG. 2 is an enlarged fragmentary view of the mounting support of the drive stations for the threading elements.

Figure 3:
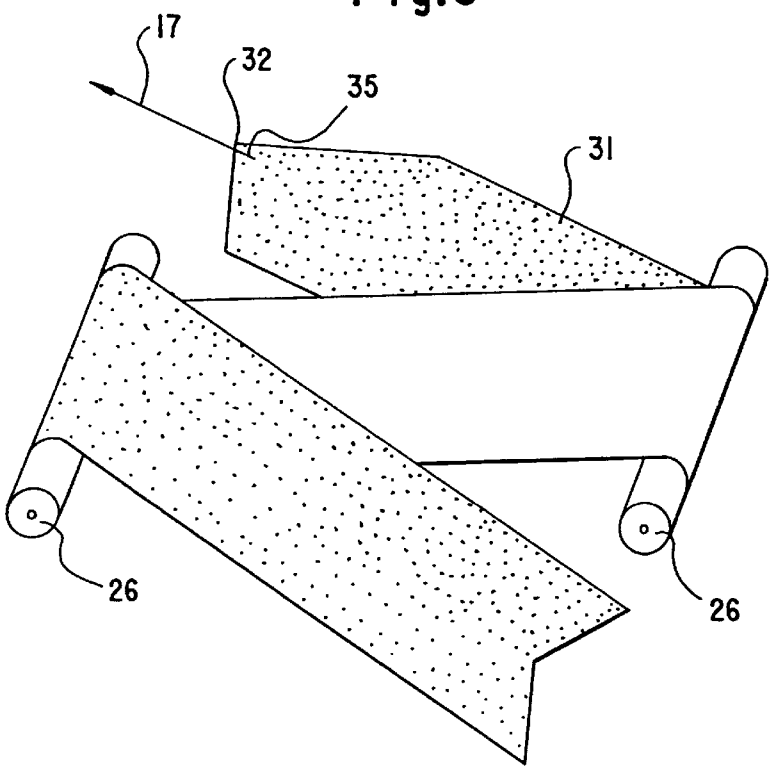
FIG. 3 is a fragmentary diagrammatic perspective view of a web path for a web.

A crossmember 10 illustrated therein accommodates the threading devices 24.1 and 24.2 and may be placed, for example, in the turning-bar superstructure 11. It is thereby possible for the web 31 or the partial webs 31.1 and 31.2 to be threaded into the superstructure 11, and the time-consuming and somewhat hazardous climbing by the pressman into the superstructure 11 in order to thread one or more new webs can thus be avoided. The drawing or pulling devices 24.1 and 24.2, which draw in the respective web threading elements 19 and 20, are displaceably mounted on the crossmember 10, so that they can be aligned precisely with respective points 32, as shown in FIGS. 3 and 4 of webs 31 or partial webs 31.1 and 31.2 to be threaded. A central introduction of force into the material webs 31, 31.1 and 31.2 is thereby assured, and tearing of the respective web due to an application of tensile forces acting on one side thereof can thus be ruled out definitively. As shown in FIG. 2, at the transporters 15 and 16 illustrated therein in stylized form, respective hook-in points 29 and 30, which may be in the form of eyes, tabs, openings or the like, are provided. They serve the purpose of fastening the ends of the web threading elements 19 and 20, which are wound on the winches of the pulling devices 24.1 and 24.2, to the respective transporters 15 and 16 for retransport to the reel changer 3. In this regard, the web threading elements 19 and 20 which are taken up by the respective transporters 15 and 16, run through the defined web path through which the webs to be threaded later are supposed to run through once. The elements 26 are diagrammatic representations of the turning bars in the superstructure 11 around which the material web 31 is wrapped. In order to indicate that, although the respective reverse transport direction 18 is identical for the threading elements 19 and 20, respectively, the web path that is traversed for the partial webs 31.1 and 31.2 to be threaded later may run differently, turning bars 26 which are positioned differently are provided in the respective web paths. This also results in different partial web paths 34.1 and 34.2 for the later threading of a partial web 31.1, 31.2.

Both a web path for one material web 31, and web paths for partial material webs 34.1 and 34.2 are Shown in FIGS. 3 and 4, respectively.

Figure 8:
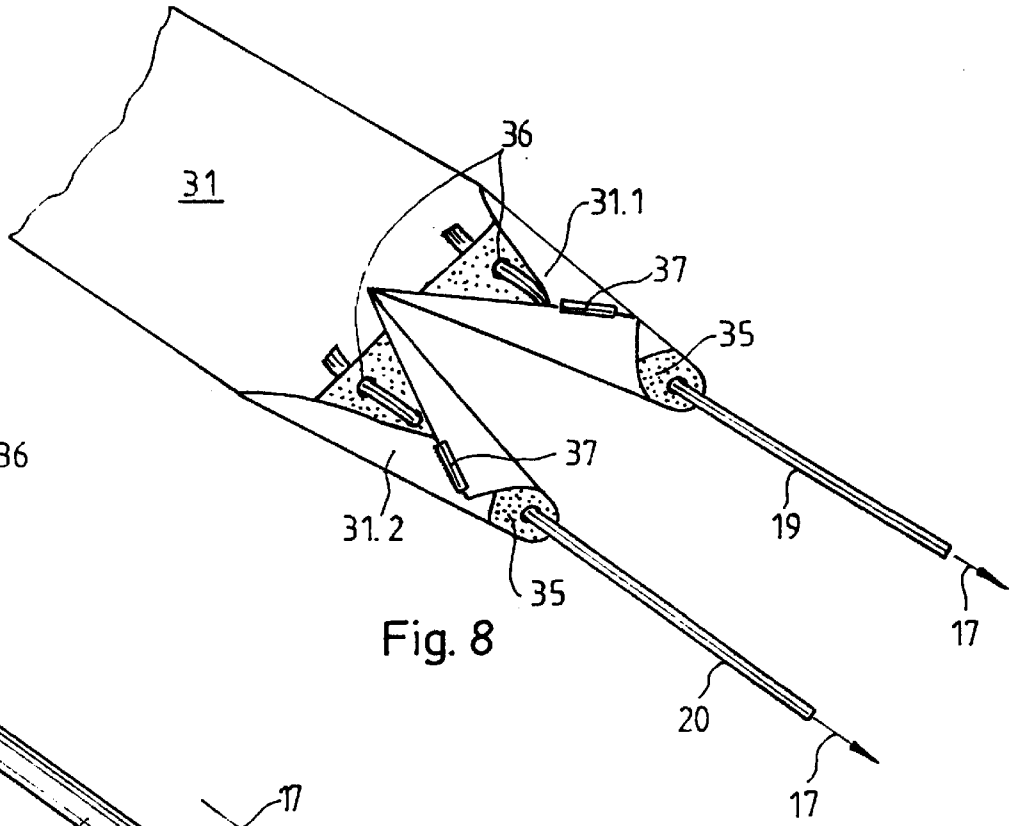
FIGS. 7 and 8 are fragmentary diagrammatic plan views of different embodiments for fastening webs or partial webs to the web threading or infeed elements.
Figure 7:
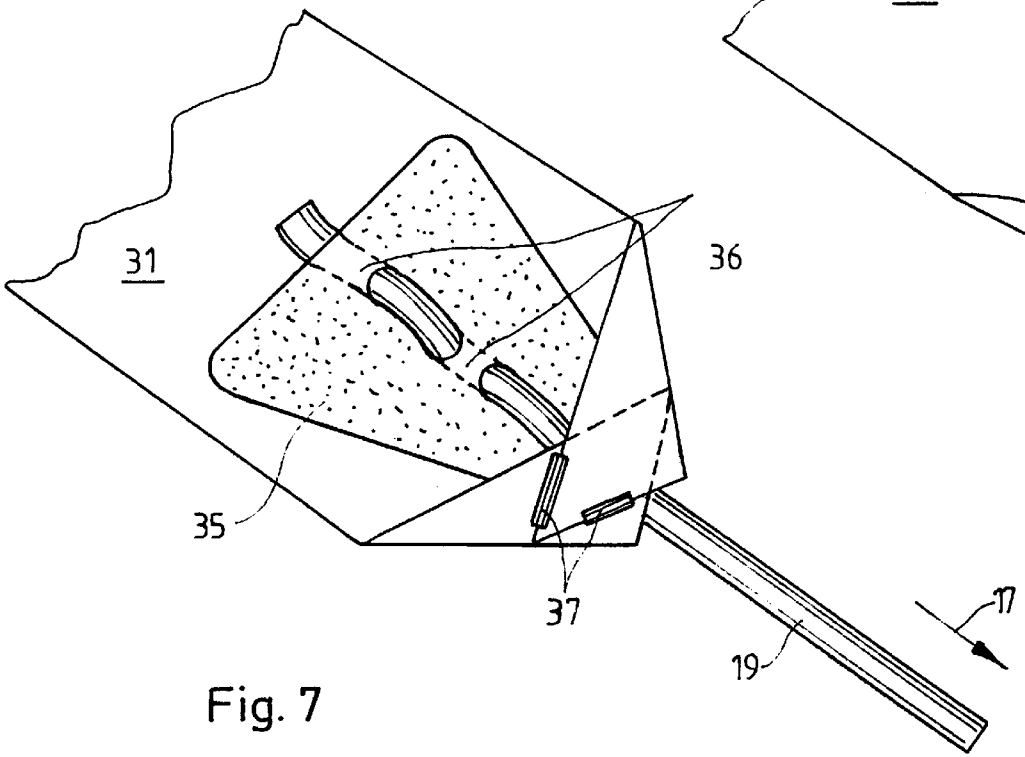

FIG. 3 shows a web path, otherwise not illustrated or specified in greater detail, for a single paper web 31 extending over turning bars 26 in one threading direction 17. The threading element 19, as shown in FIG. 1, for example, is fastened to the web point or tip 32 of the web 31. A flexible web drawing or pulling element 35, which is shown in greater detail in FIGS. 7 and 8, is used for this purpose. FIG. 4 shows the relationships when threading two longitudinally slit partial webs 31.1 and 31.2. The partial webs 31.1 and 31.2 oncoming from the original web 31 are produced by a conventional longitudinal slitting device 33, which is not otherwise illustrated or described specifically herein. The web drawing elements 35 taking up the partial webs 31.1 and 31.2 at the web points or tips 32 are connected to the threading elements 19 and 20, respectively (FIGS. 1 and 2). The latter have, in fact, been retransported to the reel changer 3 by the transport elements 15 and 16, respectively, in accordance with the respective web paths 34.1 and 34.2, and then enable the new webs 31.1 and 31.2 to be threaded in accordance with the web path defined by the reverse transport path of the threading elements 19 and 20. In this regard, it is apparent that the web paths 34.1 and 34.2 may assume quite different paths (note FIG. 2).

Figure 5:
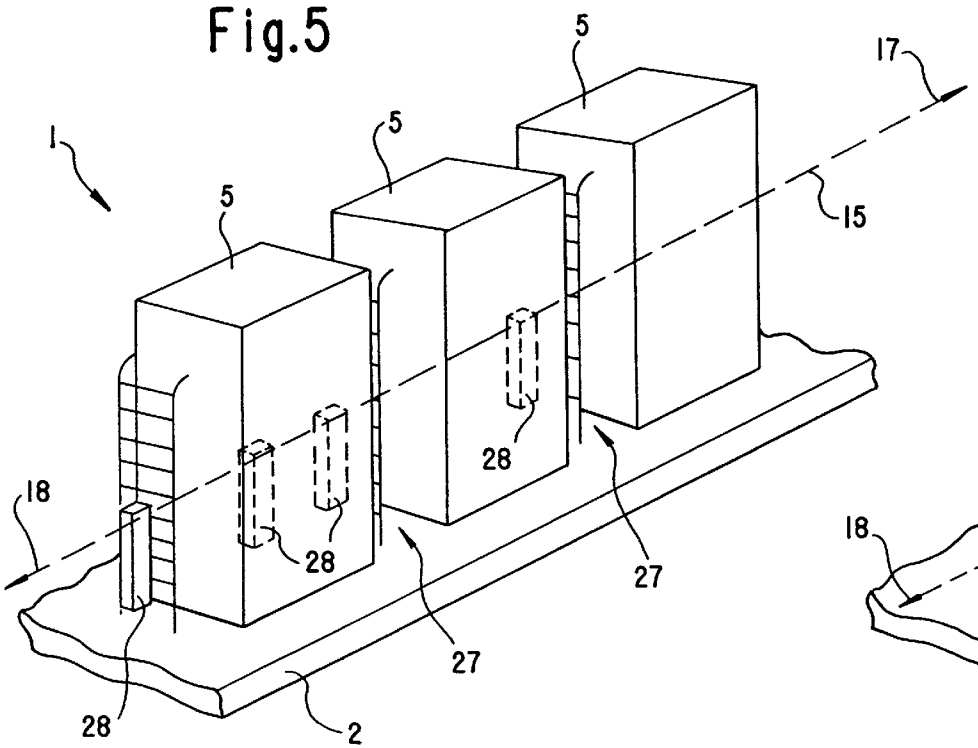
FIG. 5 is a fragmentary, diagrammatic front and operating side perspective view of the web threading device with an activated transporter or conveyor.

FIG. 5 is an elevational front and operating side perspective view of the press with activated transporters.

In this illustration, the transporter 15 is in its activated position, i.e., it is being conveyed by the drive stations 22.1 and 22.2 either in the threading direction 17 or in the reverse transport direction 18. The printing units 5, which are arranged on the foundation 2, respectively, have turning members 28 which are located on the sides assigned to the accesses 27 and with which, after web threading has been performed or the retransport of the threading elements has been completed, those parts of the transporter 15 which are located in the accesses 27 can be lowered into the foundation 2, in order to grant free access on the operating side to the printing units 5, for example. That which has been stated hereinbefore with regard to the printing units 5 also applies to the cooling-roller section 8, the dryer 7, as well as the safety device 6 and the infeeding unit 4.

Figure 6:
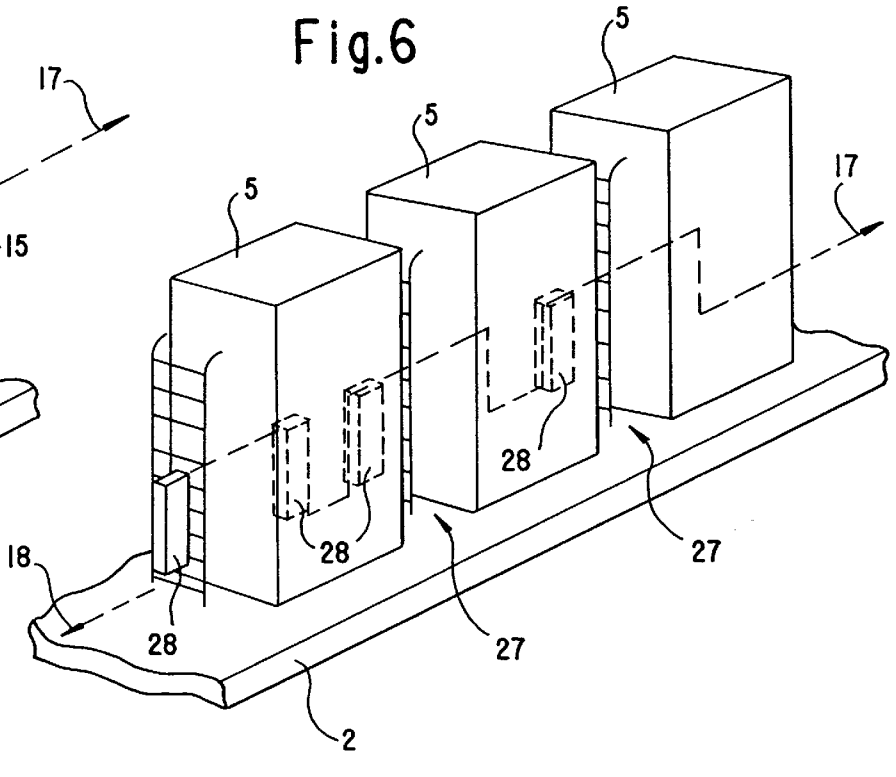
FIG. 6 is a view like that of FIG. 5 showing on the operating side, accesses to the components of the rotary press which have been enabled due to deflecting the transporter or conveyor.

Accesses to the components of the rotating rollers, enabled on the operating side, are illustrated in FIG. 6. The turning members 28 may, for example, have circular eyes which enclose the transporter 15. The eyes, mounted on the actuating cylinder of the turning members 28, are activated after the web threading has been performed, the eyes withdrawing the transporter 15 downwardly in the region of the accesses 27, with the result that the eyes can enter into recesses formed in the foundation 2, and access to the printing units 5 is thus enabled. It is clear that, instead of eyes, other components may also be considered for deflecting the transporter 15 out of a transport path in the region of the accesses 27.

Finally to be considered are FIGS. 7 and 8 wherein the fastening of the material web 31, 31.1 and 31.2 to web drawing or pulling elements 35 is illustrated. The web drawing elements 35 are formed of flexible material, such as plastic material or the like, and have an essentially triangular shape. They have a threader 36, which is formed of openings located one behind the other in the respective web drawing element 35, which take up the respective threading elements 19 and 20. The ends of the web point or tip 32 are wrapped around the drawing or pulling element 35, are fixed and thus permit the transport of the material web 31 or of the partial webs 31.1 and 31.2 in the threading direction 17. The fixing of the web threading element 35 may be performed by double-sided adhesive tape or touch-and-close, i.e., velcro, fasteners or the like. In the case of the particular embodiment shown in FIG. 8 with longitudinally slit partial webs 31.1 and 31.2, the web threading elements 35 are fastened to the threading elements 19 and 20. During the transport in the threading direction 17, the threading elements 19 and 20 are threaded into different web paths, as described hereinbefore. In order to ensure different threading paths 34.1 and 34.2 (FIG. 4), each partial web 31.1, 31.2 is provided with a threading element 35 which assumes an individual web path, independently of the other. The fastening of the web threading elements 35 to the web points or tips 32 can be performed in the manner illustrated in FIG. 7.

I claim:

1. A web threading device for rotary printing presses, comprising at least one flexible threading element for threading a material web along a web path through components of a rotary printing press, at least one transporter assigned to said at least one threading element, said transporter passing by the components of the rotary printing press, said threading element being actuatable for taking up a leading end of the material web; and a drive station mounted on a traverse for driving said threading element.

2. The web threading device according to claim 1, wherein the threading element is connectable to said transporter.

3. The web threading device according to claim 2, wherein said transporter has a connecting point for the threading element.

4. The web threading device according to claim 1, wherein said transporter runs along a side of the rotary press.

5. The web threading device according to claim 1, including drive stations for driving said transporter.

6. The web threading device according to claim 1, wherein said transporter is movable in a threading direction of the web and in a direction opposite thereto.

7. The web threading device according to claim 1, including respective drive stations for driving the threading element and for driving said transporter, said drive stations having electromotive drives.

8. The web threading device according to claim 1, including respective drive stations for driving the threading element and said transporter, said drive stations having hydraulically actuated drives.

9. The web threading device according to claim 1, wherein said transporter and the threading element, respectively, are formed of a flexible, temperature-resistant belt.

10. The web threading device according to claim 1, wherein said transporter has a chain-like construction.

11. The web threading device according to claim 1, wherein said drive stations of the threading element are displaceable on said traverse, perpendicularly to a web threading direction.

12. The web threading device according to claim 4, wherein said transporter runs on the operating side of the rotary press and enables access to the components of the rotary press via activatable turning members.

13. The web threading device according to claim 12, wherein said turning members are hydraulically actuated cylinders.

14. The web threading device according to claim 1, wherein the threading element is actuatable for taking up a web on a web threading element at a point on a leading edge of the web.

15. The web threading device according to claim 1, including at least another transporter and at least another threading element, the threading elements being respectively connectable to said transporters.

16. In a web-fed rotary printing press having a plurality of components defining a web path, a web threading device, comprising a flexible threading element for threading a material web along a web path through components of a web-fed rotary printing press, a transporter assigned to said threading element, said transporter passing by the components of the rotary printing press, said threading element being actuatable for taking up a leading end of the material web; and a drive station mounted on a traverse for driving said threading element.

17. The web-fed rotary printing press according to claim 16, wherein the components thereof include printing units arranged in tandem or above one another.

* * * * *